US009730560B2

(12) United States Patent
Flocchini

(10) Patent No.: US 9,730,560 B2
(45) Date of Patent: Aug. 15, 2017

(54) PERFORATED PAPER TOWEL DISPENSER FOR ONE-HANDED OPERATION

(71) Applicant: Andrew Flocchini, Petaluma, CA (US)

(72) Inventor: Andrew Flocchini, Petaluma, CA (US)

( * ) Notice: Subject to any disclaimer, the term of this patent is extended or adjusted under 35 U.S.C. 154(b) by 234 days.

(21) Appl. No.: 14/281,723

(22) Filed: May 19, 2014

(65) Prior Publication Data

US 2014/0339281 A1 Nov. 20, 2014

Related U.S. Application Data

(60) Provisional application No. 61/887,892, filed on Oct. 7, 2013, provisional application No. 61/824,652, filed on May 17, 2013.

(51) Int. Cl.
*A47K 10/38* (2006.01)

(52) U.S. Cl.
CPC .... *A47K 10/3836* (2013.01); *A47K 2010/389* (2013.01); *A47K 2010/3863* (2013.01); *Y10T 225/393* (2015.04)

(58) Field of Classification Search
CPC ..... A47K 10/38; A47K 2010/3836; A47K 2010/389; A47K 10/32; A47K 10/34; A47K 10/00; Y10T 225/393
See application file for complete search history.

(56) References Cited

U.S. PATENT DOCUMENTS 4,508,291 A * 4/1985 Kosch ..... B65H 59/04 242/597.7
7,104,418 B2 9/2006 Kamenstein
7,290,733 B2 * 11/2007 Kamenstein ..... B65H 75/245 242/598.2
2007/0262191 A1 * 11/2007 Amron ..... A47K 10/3836 242/597.7

* cited by examiner

*Primary Examiner* — Jonathan Riley
*Assistant Examiner* — Liang Dong
(74) *Attorney, Agent, or Firm* — Craig M. Stainbrook; Stainbrook & Stainbrook, LLP

(57) ABSTRACT

A paper towel dispenser including a base; a center shaft vertically mounted on the base; a spool mount tube rotatably disposed around the center shaft; a biasing element engaging the spool mount tube and placing it at an angle in relation to the center shaft, and brake elements disposed between the center shaft and the spool mount tube. When a user pulls a free end of a paper towel roll outwardly ion a defined direction, the spool mount tube tilts and the brake elements disengage, allowing the spool mount tube to rotate and also allowing paper towel sheets to pay out. If the user pulls at an angle relative to the center shaft on the free end of the paper towel roll, the brake elements engage and prevent rotation of the spool mount tube, thus allowing the user to tear off and separate the dispensed paper towel sheets.

9 Claims, 10 Drawing Sheets

PERFORATED PAPER TOWEL DISPENSER FOR ONE-HANDED OPERATION

CROSS REFERENCES TO RELATED APPLICATIONS

The present application claims the benefit of U.S. Provisional Patent Application Ser. No. 61/887,892, filed Oct. 7, 2013 (Oct. 7, 2013), and U.S. Provisional Patent Application Ser. No. 61/824,652, filed May 17, 2013 (May 17, 2013).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Field of the Invention: Dispensers for dispensing sheets from a roll of perforated or non-perforated paper towels are generally intended for operation using both hands. One handed operation is notoriously clumsy and unreliable. Unfortunately, when the need for a paper towel arises, two hands are not always available for the task. Just about anyone in a modern kitchen has attempted to pull paper towels from a dispenser with one hand, only to struggle with the apparatus to get a sheet to tear properly in the first instance, and to prevent free spooling of the roll and thus waste in the second. There remains an unfulfilled need for a paper towel dispenser capable of reliable one-handed operation in which a user can select and remove one or more sheets of one or more paper towels (or a length of paper of any desired length) while operating the dispenser with only one hand. The inventive apparatus provides the solution for that long felt and unfulfilled need.

SUMMARY OF THE INVENTION

It is therefore a principal object of the invention to provide an improved paper towel dispenser that enables users to dispense and separate a desired number of perforated towel sheets or a length of paper from a paper towel roll using only one hand.

It is another object of the present invention to provide an improved paper towel dispenser that prevents free pay out of the free end of paper towels when the . . . .

To achieve these ends, there is described herein an improved paper towel dispenser that facilitates one-handed dispensing of paper towel sheets from a roll of perforated paper towels, which in its most essential aspect comprises: a base; a center shaft vertically mounted on the base; a cylindrical spool mount tube rotatably disposed around the center shaft; a biasing element engaging an interior side of the spool mount tube so as to place the spool mount tube at an angle in relation to the center shaft when not in use; and brake elements disposed between the center shaft and the spool mount tube; wherein when a user pulls a free end of a paper towel roll outwardly and away from the center shaft in a direction opposite the direction of force imparted by the biasing element against the interior side of the spool mount tube, the spool mount tube tilts into a generally upright orientation and the brake elements disengage so as to allow the spool mount tube to rotate in relation to the center shaft, thereby allowing paper towel sheets to pay out until the user wishes to tear the towel sheets away from the paper towel roll, at which point if the user pulls upwardly on the free end of the paper towel roll, the brake elements are brought into engagement and rotation of the spool mount tube is prevented, thereby allowing the user to tear off and separate the dispensed paper towel sheets from the paper towel roll.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
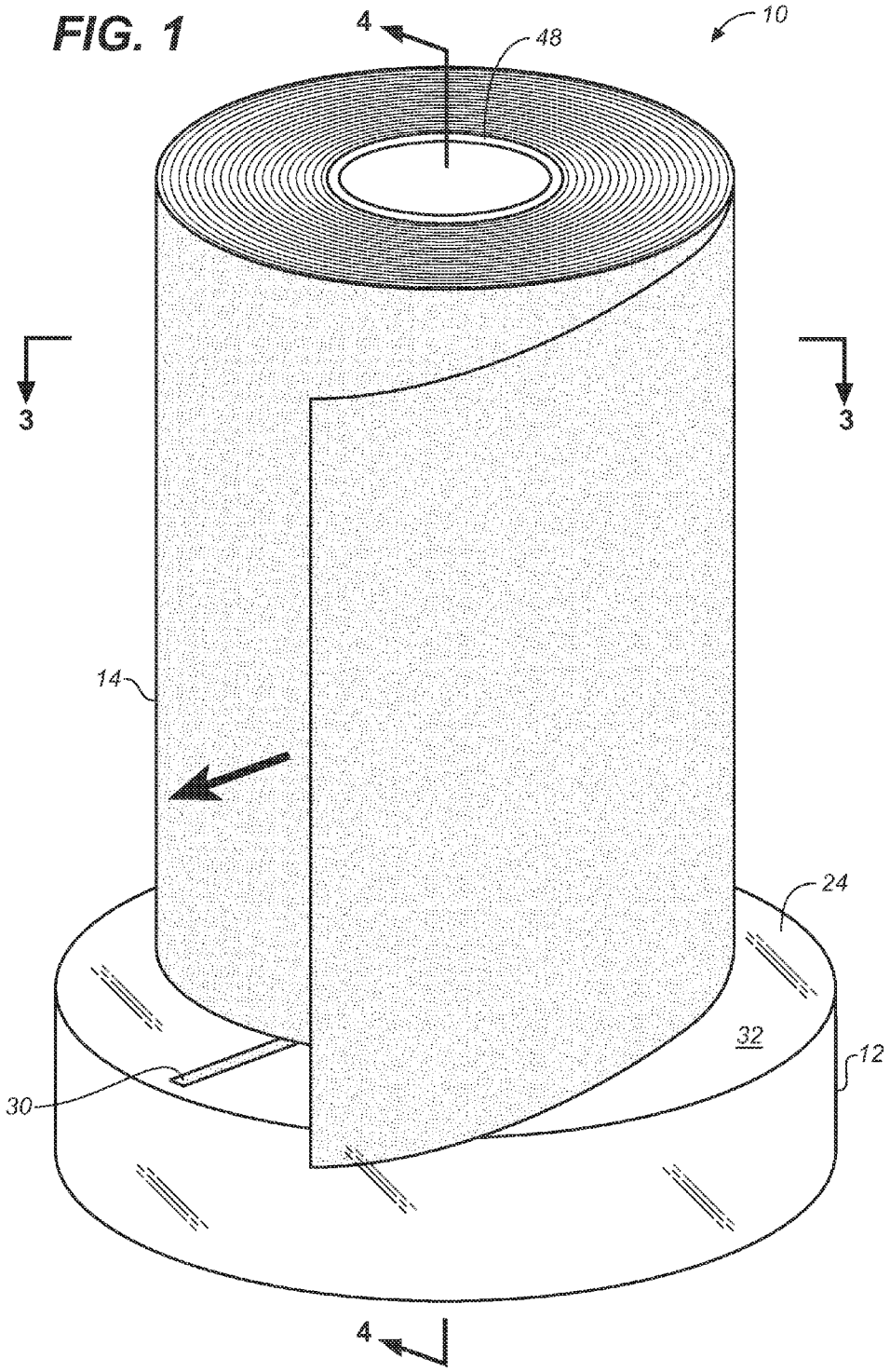
FIG. 1 is an upper front left perspective view of a first preferred embodiment of the inventive paper towel dispenser for one handed operation, showing the dispenser with a roll of paper towels installed but with no liquid container disposed in its top portion.

Referring first to FIGS. 1 through 9, wherein like reference numerals refer to like components in the various views, there is illustrated therein a new and improved paper towel dispenser for one-handed operation, generally denominated 10 herein. The views collectively show a first preferred embodiment of the invention, which comprises a base 12, preferably a round or disk-shaped base, though any decorative shape may be employed. The base may have ballast or weight sufficient to resist tipping when towels on a paper towel roll 14 are pulled outwardly, and to that end, the base may be fabricated either from a dense material or provided with base plate 16 secured to a bottom edge 18 of an inverted shallow hollow cylinder 20 so as to define an interior space into which a dense material 22, such as sand, may be disposed. Placement of such material can be accomplished by inserting it through an opening in the base plate 16, or alternatively in the top 24 of the base, and retained in the base by a closure 26. The base material may be transparent, or substantially so, for instance by using polycarbonate material, and the sand may be colored sand. Thus, a good measure of decorative flexibility can be achieved such that the sand can be custom colored to match kitchen or other ambient colors.

The base provides stability to the dispenser, and when not affixed to the surface, may be provided with rubber feet 28 so as to prevent slippage when in use, or it can be secured to a surface using fasteners, suction, clamps, or the like. In that vein, the base may be installed on wall instead of a horizontally disposed surface.

A pull line indictor 30 is placed, either flush or slightly produce relative to the top surface 32 of the base. This provides an indication of how a user should orient the apparatus for use.

A cylindrical center shaft 34 extends vertically up from the base, either integral with the base or affixed to the base plate 16 or the base top 24 at its lower end 36 using a bolt 38 in a well-known manner.

Proximate the center shaft lower end 36 and disposed atop the base is a wear plate 40, preferably annular or disk shaped. Disposed atop and extending upwardly from the center shaft 34 is a biasing element, preferably a leaf spring 42 with an arm 44 on which is mounted a roller 46 and urged by the leaf spring into engagement with the spool 48 or cylindrical cardboard core at the center of a paper towel roll 14. The leaf spring is installed on an upper shaft portion 50 of center shaft 34, which is either integral with and extending from the top 52 of center shaft 34 or attached thereto, and which has a diameter smaller than that of the primary (lower) portion of the center shaft 34. The leaf spring is embedded in or attached to the upper shaft portion using a fastener 54, such as a blind rivet or bolt. It further includes a bent or angled portion 56 disposed against a slanted portion 58 of upper shaft portion 50. Center shaft 34 further includes a circumferential channel 60, the purpose of which is made more apparent from the description that follows.

A spool mount tube 62 is rotatably mounted over center shaft 34 and upper shaft portion 50. The spool mount tube generally includes a bottom flange 64 and a tube portion 66, the latter having an interior diameter slightly larger than that of center shaft 34; and with the diameter of the upper shaft portion 50 being small than that of the center shaft 34, it can be seen that the assembly of the leaf spring 56 and roller 46 pushes against the interior wall of the spool mount tube to urge it into a tilted orientation. When so oriented, friction elements, including upper and lower O-rings, 68, 70, each disposed around the center shaft and preferably located in channels in the interior wall of the tube portion 66, come into engagement with a friction element engaging surface on the center shaft 34, and bottom flange 64 comes into engagement with wear plate 40 to prevent rotation of the paper towel 14 roll around center shaft 34.

Further, means are provided to hold the bottom flange above the base and to prevent longitudinal translation of the spool mount tube 62 upwardly in relation to center shaft 34 and upper shaft portion 50. In a preferred embodiment, these include first and second spacing/retaining pins 74, 76 disposed through the tube portion and insert slightly into groove 60 so as to space the tube portion 66 from center shaft 34. The pins extend into the groove 60 sufficiently to prevent the spool mount tube from translating longitudinally up and off center shaft 34 and upper shaft portion 58; however, the retaining pin ends are spaced apart from the side of center shaft 34 so as to allow rotation of spool mount tube 62 when in the unlocked configuration while dispensing material. The channel 60 and retaining pins are configured so as to keep the bottom flange 64 of the spool mount tube held slightly above the base or wear plate 40 as well as to prevent longitudinal translation. Tube portion 66 may be capped with a cap 78 at its upper end 80, which cap provides a platform on which to support an article, such as a container 82 for liquid soap.

At its lower end 84, at the junction of flange 64 and tube portion 66, angled pins 86, 88 or other elements may be provided so as to prevent the paper towel roll from rotating in relation to tube portion 66.

A final structural and operational element, stop 90 extends outwardly from upper shaft portion 50 so as to prevent the spool mount tube from tilting too far forwardly, toward pull line 30, when in operation.

Figure 2A:
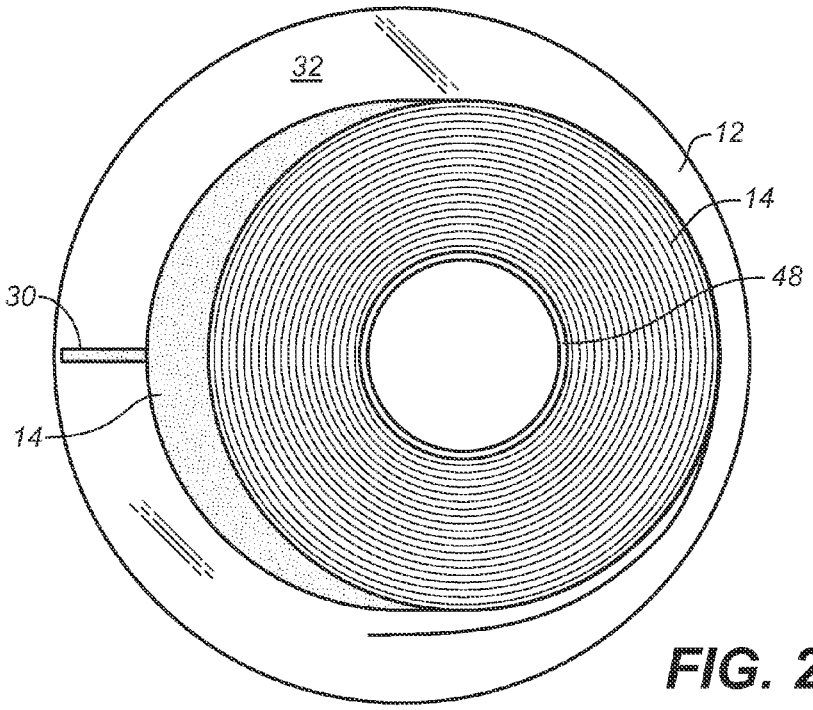
FIG. 2A is a schematic cross-sectional top plan view showing the orientation of the apparatus when in the locked configuration.
Figure 3A:
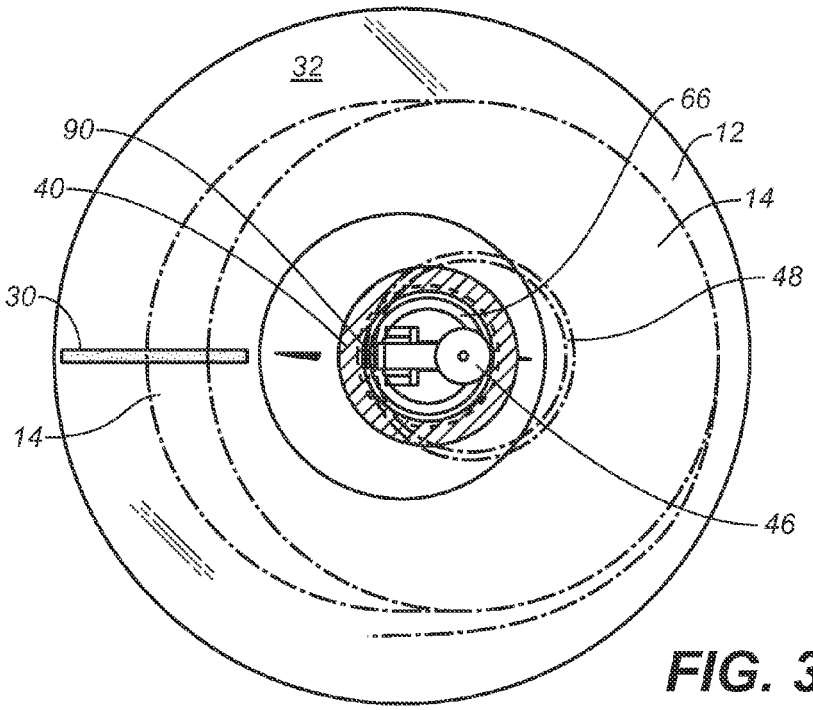
FIG. 3A is a top plan view corresponding to each of FIGS. 2A and 2B, taken along Section line 3-3 of FIG. 1, wherein the paper towel roll sheets and cardboard core are each shown in dashed lines.
Figure 4A:
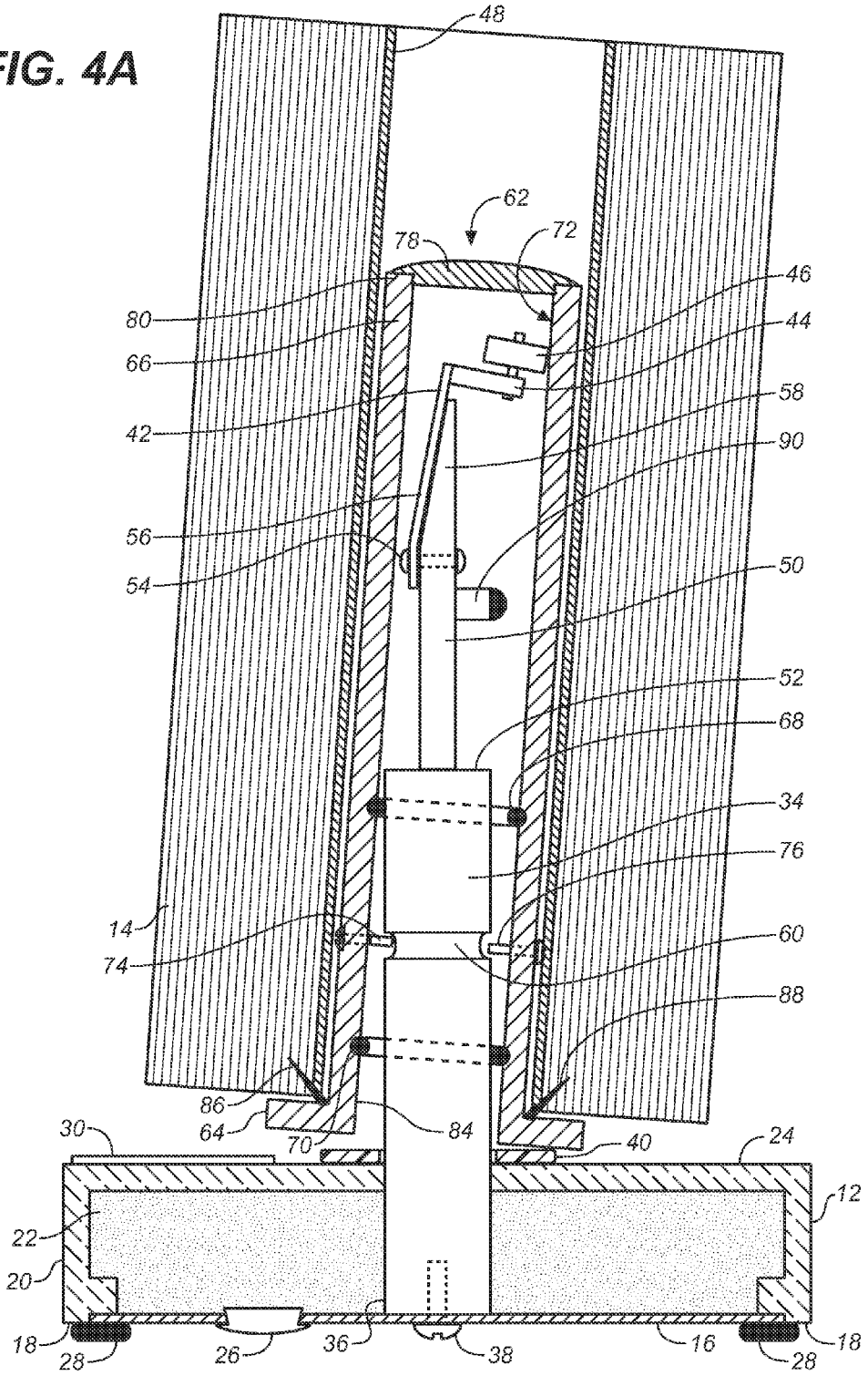
FIG. 4A is a cross-sectional side view in elevation showing the dispenser in the locked configuration of FIGS. 2A and 3A as taken along Section Line 4-4 of FIG. 1.

Referring now to FIGS. 2A, 3A, and 4A, in a locked configuration leaf spring 42 urges spool mount tube 66 into a tilted orientation so as to bring O-rings 68, 70 into engagement with center shaft 34 and a portion of flange 64 into an angled or tipped engagement with wear plate 40, thereby preventing rotation of spool mount tube or so as to provide resistance to rotation sufficient to enable a user to tear off a sheet of perforated paper.

Figure 2B:
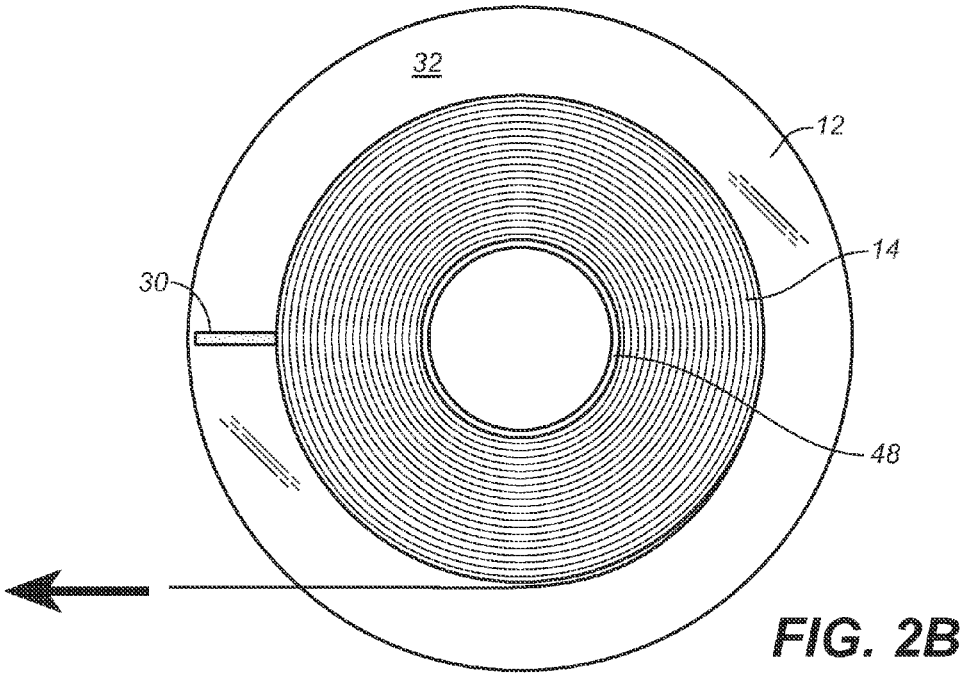
FIG. 2B is a schematic top plan view showing the orientation of the apparatus when in the unlocked configuration for dispensing sheets of paper towels.
Figure 3B:
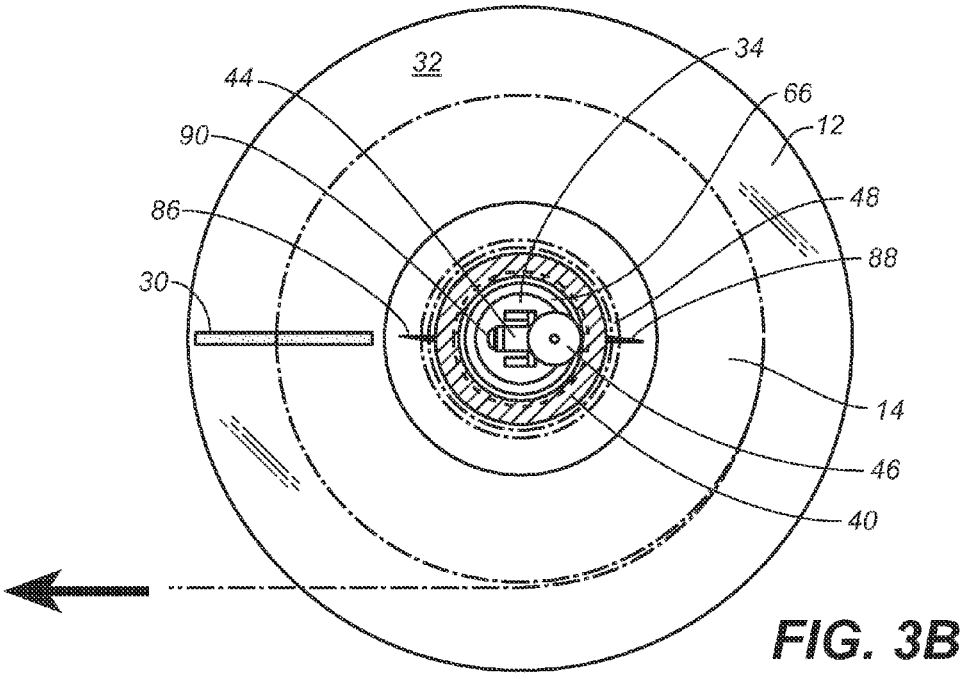
FIG. 3B is a cross-sectional top plan view corresponding to FIG. 2B only and taken along Section line 3-3 of FIG. 1, wherein the paper towel roll sheets and cardboard core are again each shown in dashed lines.
Figure 4B:
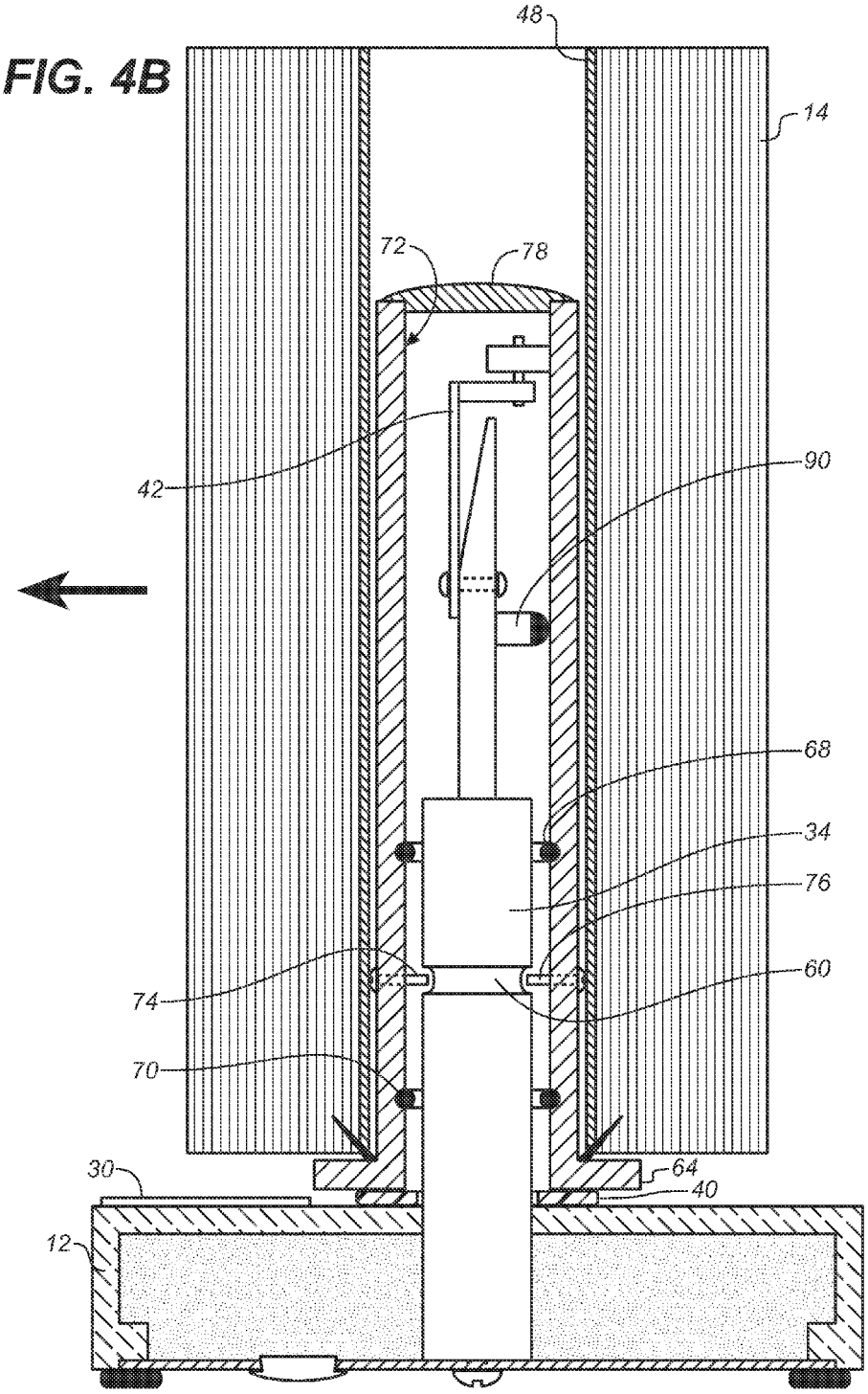
FIG. 4B is a cross-sectional side view in elevation showing the dispenser in the unlocked and operational (dispensing)) configuration of FIGS. 2B and 3B.
Figure 5:
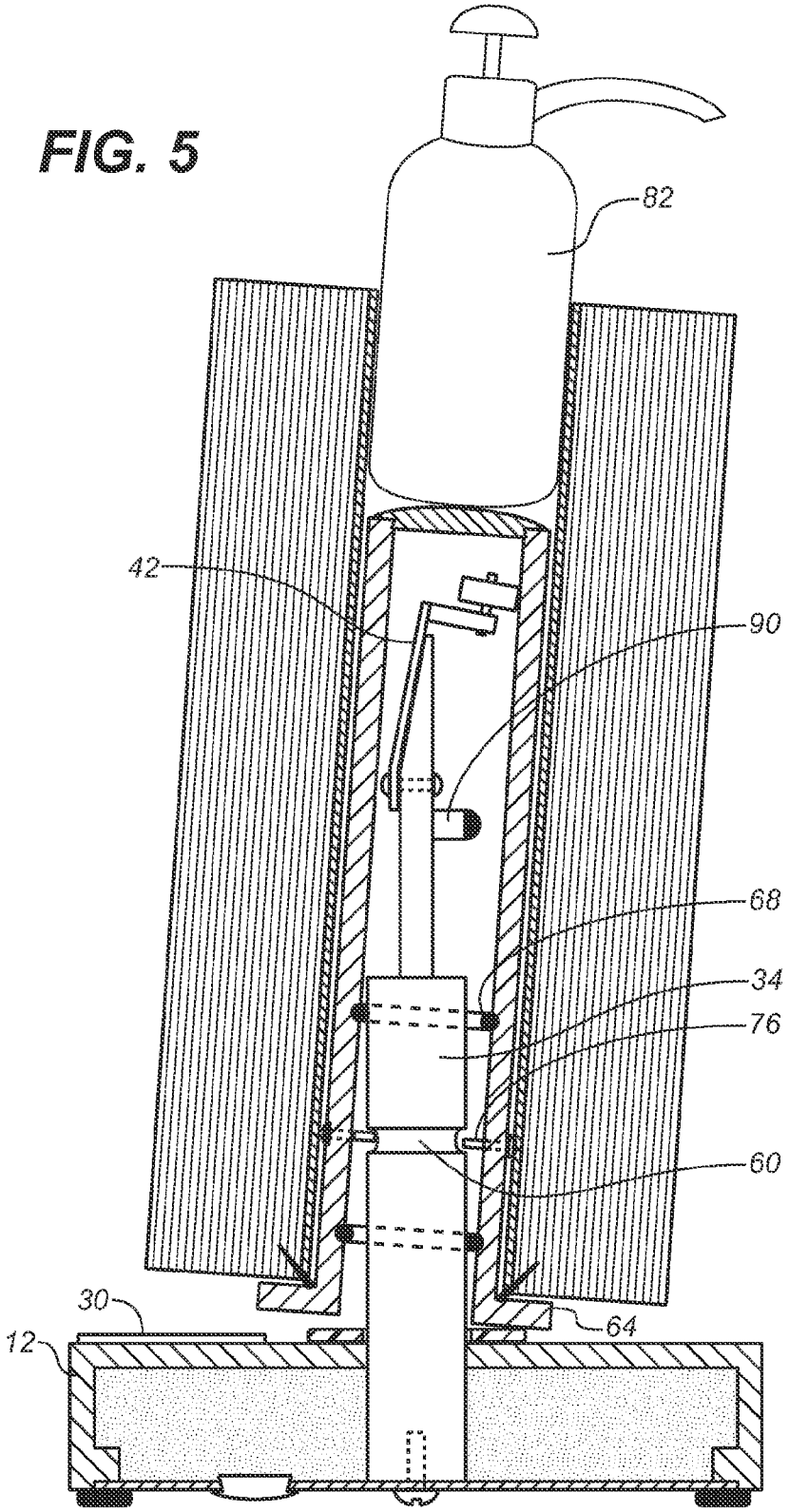
FIG. 5 is cross-sectional side view in elevation showing the dispenser in the locked configuration and having a liquid soap dispenser disposed in the open top portion of the apparatus.
Figure 6A:
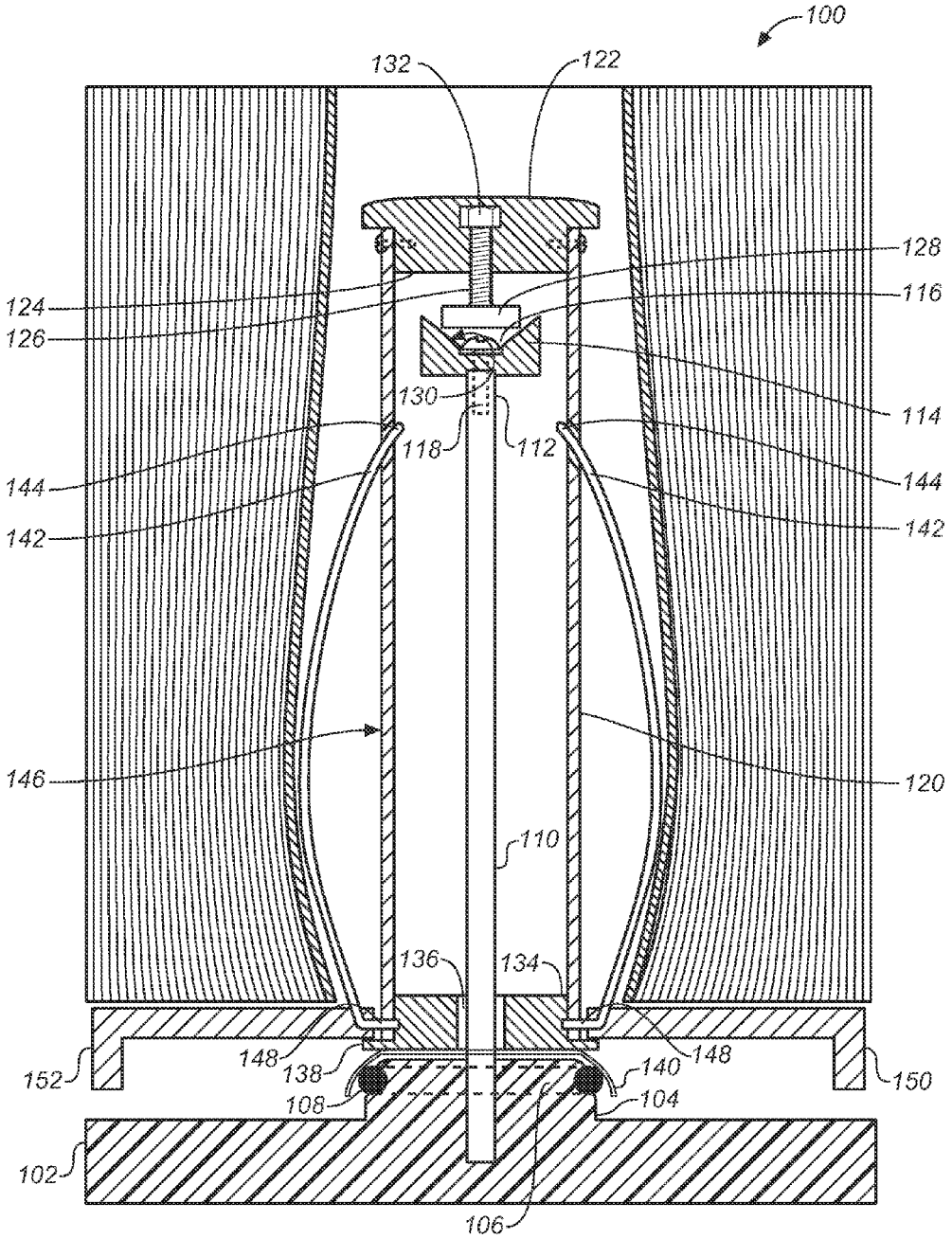
FIG. 6A is a cross-sectional side view in elevation of a second preferred embodiment of the inventive paper towel dispenser, shown in a locked position.
Figure 6B:
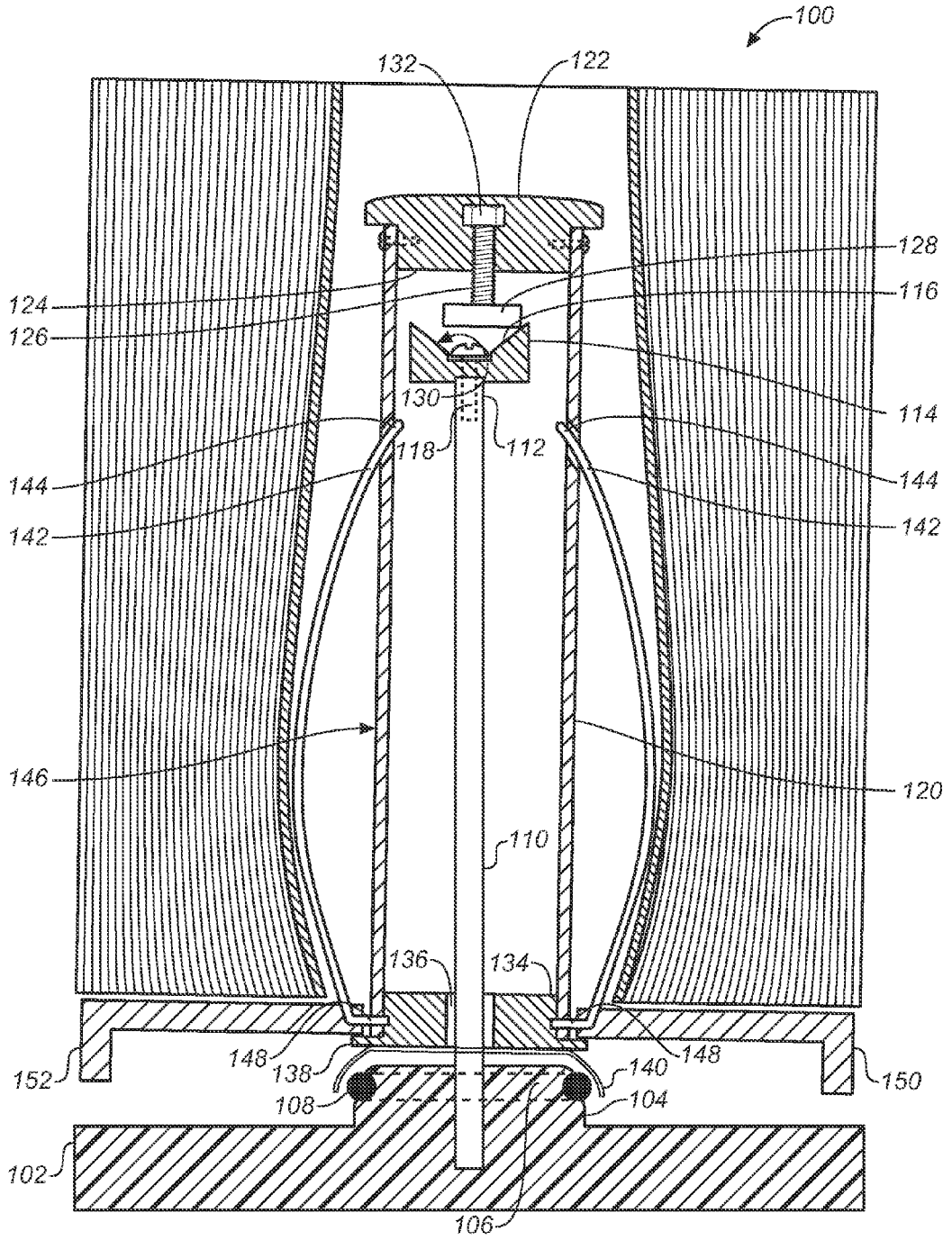
FIG. 6B is a cross-sectional side view in elevation thereof, showing the dispenser in an unlocked position as a user pulls a section of paper towel from the towel roll.
Figure 7:
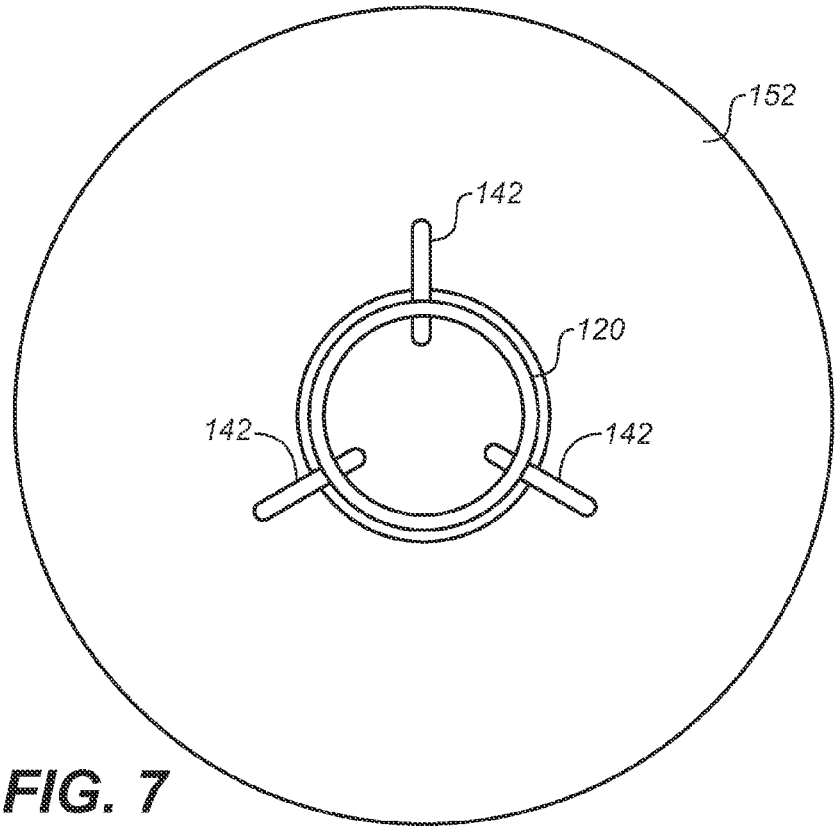
FIG. 7 is a top plan view showing in highly schematic form the base, spooling tube, and hoop springs on which a paper towel roll is placed.

When a user wishes to remove one or more sheets of perforated paper towels from the roll 14, he or she need only pull the free sheet in the direction of pull line 30, which pulls and tilts the spool mount tube 62 and paper towel roll 14 into a substantially upright orientation (see FIGS. 2B, 3B, and 4B). As long as the user pulls generally parallel with pull line 30, the paper roll will spool freely and towel sections will pay out as quickly as desired. When the user wishes to tear off the selected paid out sheets, he or she simply pulls upwardly, which releases tension on the upper portion of the spool mount tube 62, thereby allowing leaf spring 42 to urge flange 64 back into angled engagement with wear plate 40, and simultaneously bringing upper and lower O-rings 68, 70, respectively, into engagement with center shaft 34, generally on opposites sides (180 degrees apart) of the cylindrical center shaft. Collectively, these elements introduce significant friction and thus resistance to rotation of spool mount tube, and thereby allow the user to tear of the selected sheets of perforated paper towels. This can be accomplished entirely with one hand.

Referring next to FIGS. 6A through 8, there is shown a second preferred embodiment of the inventive paper towel dispenser. In this embodiment, the paper towels may be pulled and dispensed in any direction; the orientation of the dispenser (other than the vertical orientation of the paper roll) no bearing on its operability and there is, therefore, no pull line included. The second preferred embodiment 100 includes a base 102, on which an O-ring support 104 is mounted, either as an independent piece and affixed with fasteners or adhesives, or by being integrally formed, as shown. The O-ring support 104 includes a channel 106 onto which an O-ring 108 is installed.

Vertically disposed from, and affixed to the base, is a support rod 110, which functions as the mechanical support and geometric axis around which all action within the apparatus takes place. It is secured onto and/or within the base by being inserted into and through the center of the O-ring support and then into the base. At its upper end 112, support rod 110 has a disk 114 with a conical recess 116 secured with a screw 118.

Axially disposed around support rod 110 is a spooling tube 120 having a top cap 122. Extending downwardly from the underside 124 of cap 122 is a threaded adjustable shaft 126, at the end of which a circular or disk-shaped slide plate 128 is disposed. When adjusted, slide plate 128 is spaced apart from the upper surface 130 of conical recess 122. Adjustment of slide plate 128 is accomplished by turning it in relation to an adjustment nut 132 embedded or otherwise disposed in cap 122. Small adjustments can be made, either at the time of manufacture or by the consumer, to space slide plate 128 from the upper surface 130 of conical recess 122 so as to fine-tune the essential spooling and braking functions of the apparatus. The upper surface 130 is preferably a smooth low friction surface to facilitate sliding movements of slide plate 128 up and down the inclined conical recess 116 of disk 114 and rotation of slide plate around the upper surface 130 of disk 114.

At its lower end, spooling tube 120 includes a base plug 134 having a center hole 136 axially disposed around support rod 110 with a clearance such that it can spin or rotate freely. A flange 138 on the lower portion of the base plug extends radially out from the circumference of the base plug. Depending downwardly from the underside of base plug 134 in an inverted orientation is a brake cup 140 which extends over and engages O-ring 108 when at rest (i.e., a locked position, FIG. 6A).

A roll of paper towels PT is mounted on the apparatus using a plurality, preferably three, spring steel hoops 142, which each have an upper end 144 disposed in the side 146 of spooling tube 120, and a lower end 148 bent and inserted through spooling tube 120 and into base plug 134.

A circular towel tray 150 with a circumferential skirt 152 surrounds and is attached immediately above the brake cup 140 and around the lower portion of the assembly at the lower ends 148 of hoops 142, spooling tube 120, and base plug 134.

When not in use (see FIG. 6A), brake cup 140 sits atop O-ring 108 in substantially complete engagement with the O-ring. This prevents rotation of the paper towel roll PT and is thus characterized as a locked position. When a user wishes to remove one or more sections of towels (FIG. 6B), he or she simply pulls outwardly, radially relative to the vertical support rod 110. This pulls the entire assembly laterally, and thus brings slide plate 128 into contact with the upper surface 130 of conical recess 116. The surface and the disk are both surface coated with materials that reduce friction between the surfaces, such that the disk smoothly slides up the side of the conical recess surface and pulls brake cup 140 off from O-ring 108, thereby disengaging it and bringing the apparatus into an unlocked position. In this position, the towel roll will spool freely as the user pulls on a section of paper towel.

When the user then wishes to tear off the section of towel(s) dispensed, he or she simply pulls downwardly at an angle on the towel sections being dispensed (approximately 45 degrees in a preferred embodiment), and this action pulls slide plate 128 down the upper surface 130 of conical recess 116, such that the brake cup 140 returns to full engagement with O-ring 108. With the apparatus now in the locked position, the user tears the sections off with ease.

Figure 8:
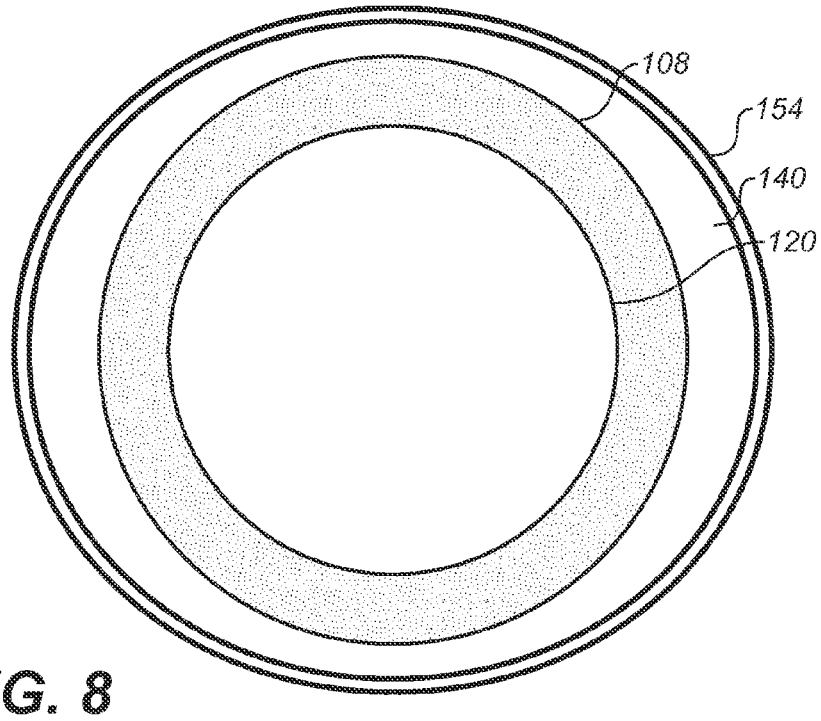
FIG. 8 is a bottom plan view showing the eccentric geometry of the cup or flare in relation to the O-ring.

Looking now at FIG. 8, we see that the shape of the lower edge 154 of brake cup 140 is slightly eccentric, which reduces chatter if it engages O-ring 108 when spooling.

Figure 9:
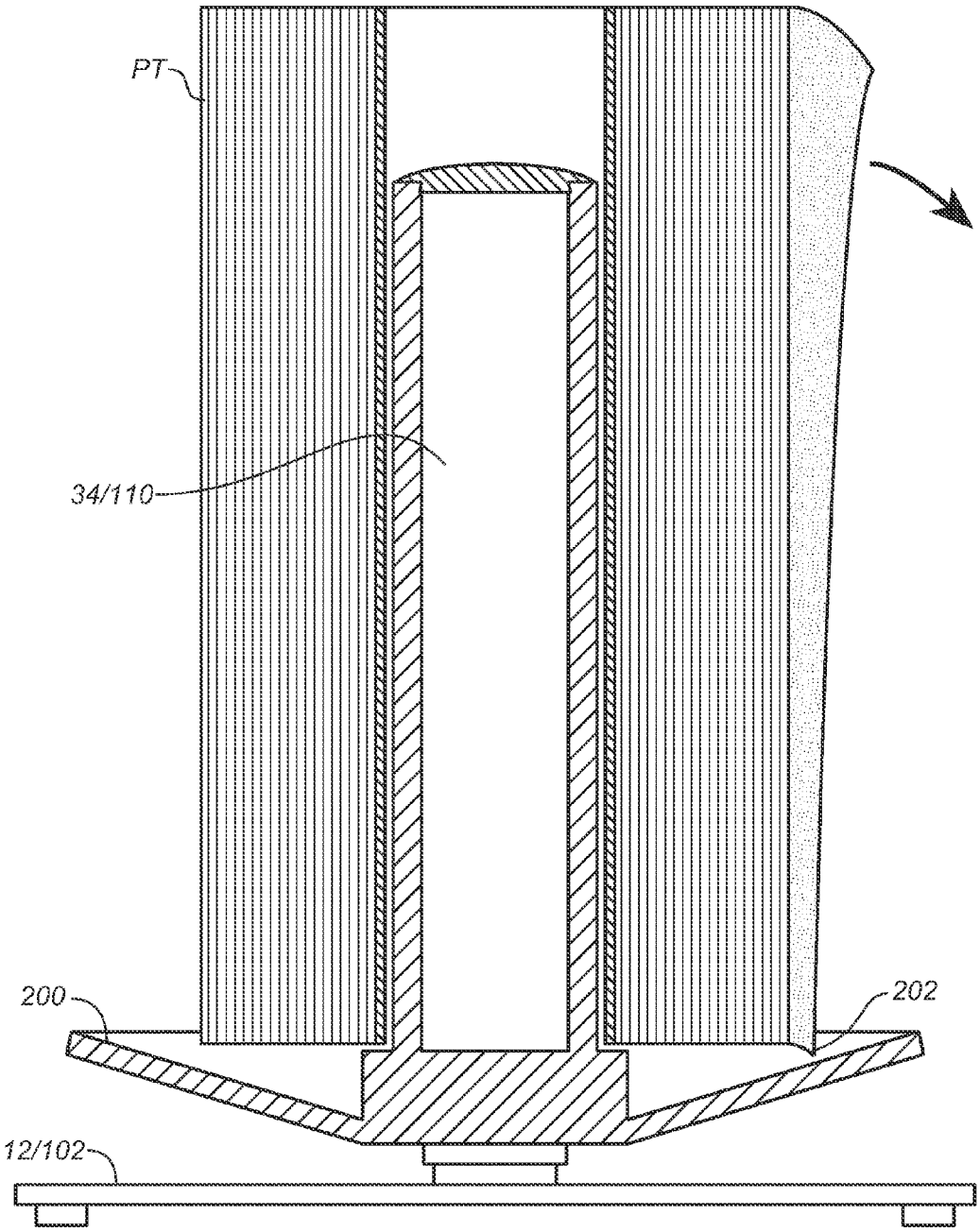
FIG. 9 is a schematic cross-sectional side view in elevation of an auxiliary base feature that may be used in conjunction with either of the first or second preferred embodiments of the paper towel dispenser of the present invention.

Looking next at FIG. 9, there is shown an enhancement that may be employed with either of the above-described preferred embodiments of the paper towel dispenser of the present invention. In this view the mechanical and structural elements are depicted schematically to illustrate that they may be either of the kind shown in FIG. 1-5 or 6A through 8. The enhancement comprises a funicular dish 200 axially disposed around vertical support or center shaft 34/110 vertically disposed on base 12/102 and functions to prevent the free end 202 of the paper towel roll PT from unrolling or falling out and away from the roll. This element dispenses with the need to use a spring-biased lever arm to hold the free tail in place.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A paper towel dispenser having an unlocked position and a locked position, comprising:

a base;

a friction element support on said base;

a friction element mounted on said friction element support;

a support rod vertically mounted on said base and said friction element support;

a cylindrical spooling tube rotatably disposed around said support rod, said spooling tube having an upper end and a lower end, a cap mounted on said upper end, and a brake cup mounted on said lower end;

a conical disk mounted atop said center shaft and having a conical recess with an upper surface;

a slide element disposed under said cap and engaging the upper surface of said conical recess in said conical disk, said slide element slidably movable along said upper surface;

wherein said slide element moves upwardly on said upper surface of said conical recess to disengage said brake plate from said friction element when in the unlocked position to permit said spooling tube to rotate, and downwardly on said upper surface to bring said brake cup into engagement with said friction element to achieve the unlocked position to prevent said spooling tube from rotating.

2. The paper towel dispenser of claim 1, further including a center bolt extending downwardly from an underside of said cap and on which said slide element is disposed.

3. The paper towel dispenser of claim 1, wherein said slide element is disk-shaped.

4. The paper towel dispenser of claim 1, wherein said slide element and said upper surface of said conical recess are each fabrication from a low friction material.

5. The paper towel dispenser of claim 1, wherein said brake cup is affixed to a base plug inserted into the lower end of said spooling tube.

6. The paper towel dispenser of claim 5, wherein said friction element is an O-ring.

7. The paper towel dispenser of claim 1, wherein said friction element is an O-ring.

8. The paper towel dispenser of claim 1, further including a towel tray extending from and engaging said base plug.

9. The paper towel dispenser of claim 1, further including spring hoops disposed around said spooling tube.

* * * * *